US009358814B2

(12) United States Patent
Izawa et al.

(10) Patent No.: US 9,358,814 B2
(45) **Date of Patent: *Jun. 7, 2016**

(54) LABEL PAPER PROCESSING APPARATUS WITH LASER PROCESSING UNIT AND LOOP FORMING UNITS

(71) Applicant: MIYAKOSHI PRINTING MACHINERY CO., LTD., Narashino-shi, Chiba (JP)

(72) Inventors: Hideo Izawa, Narashino (JP); Takao Namiki, Narashino (JP); Akira Ishikawa, Narashino (JP); Yuuichi Yamazaki, Narashino (JP)

(73) Assignee: MIYAKOSHI PRINTING MACHINERY CO., LTD., Narashino-Shi, Chiba (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/469,120

(22) Filed: Aug. 26, 2014

(65) Prior Publication Data

US 2015/0078798 A1 Mar. 19, 2015

(30) Foreign Application Priority Data

Sep. 13, 2013 (JP) ..... 2013-190550

(51) Int. Cl.
*B41J 11/66* (2006.01)
*B41J 15/00* (2006.01)
(Continued)

(52) U.S. Cl.
CPC ..... *B41J 11/666* (2013.01); *B41J 3/4075* (2013.01); *B41J 11/663* (2013.01); *B41J 15/005* (2013.01);
(Continued)

(58) Field of Classification Search
CPC ..... B41J 15/005; B41J 3/4075; B41J 11/663
See application file for complete search history.

(56) References Cited

U.S. PATENT DOCUMENTS 5,079,569 A * 1/1992 Bunch, Jr. ..... 346/136
5,611,272 A 3/1997 Steuer et al.
(Continued)

FOREIGN PATENT DOCUMENTS

DE 9420707 U1 3/1995
DE 19929272 A1 * 12/2000 ..... B41J 2/005
(Continued)

OTHER PUBLICATIONS

Extended European Search Report dated Jan. 20, 2015 issued in counterpart European Application No. 14184176.7.
(Continued)

*Primary Examiner* — Daniel J Colilla
(74) *Attorney, Agent, or Firm* — Holtz, Holtz & Volek PC

(57) ABSTRACT

A label paper processing apparatus includes a paper supply unit for supplying and feeding label paper, a digital printing unit for printing the label paper, a laser processing unit, and a pair of loop forming unit disposed between the paper supply unit and the digital printing unit, and between the digital printing unit and the laser processing unit, respectively, each forming a loop of the label paper. The laser processing unit is designed to half-cut the printed label paper and to form cut-outs of a shape along a printed cutting locus with a laser beam so as to scan and trace the printed cutting locus, thereby facilitating control in half-cutting of the label paper. The loop forming unit is designed to form a loop of the label paper and to hold a length of the loop substantially constant so as to control feeding of the label paper.

3 Claims, 3 Drawing Sheets

(51) Int. Cl.

| | |
|---|---|
| ***B41J 3/407*** | (2006.01) |
| ***B41J 15/16*** | (2006.01) |
| ***B65H 20/32*** | (2006.01) |
| ***B65H 23/188*** | (2006.01) |

(52) U.S. Cl.

CPC ..... *B41J 15/16* (2013.01); *B65H 20/32* (2013.01); *B65H 23/188* (2013.01); *B65H 2408/215* (2013.01); *B65H 2511/112* (2013.01); *B65H 2513/104* (2013.01); *B65H 2801/15* (2013.01)

(56) References Cited

U.S. PATENT DOCUMENTS

| | | | | |
|---|---|---|---|---|
| 6,052,144 | A * | 4/2000 | Reyner | 347/262 |
| 6,227,731 | B1 * | 5/2001 | Kralles et al. | 400/611 |
| 6,498,319 | B1 | 12/2002 | Matsumoto et al. | |
| 6,677,553 | B2 | 1/2004 | Matsumoto et al. | |
| 2003/0126962 | A1 * | 7/2003 | Bland et al. | 83/13 |
| 2005/0158107 | A1 * | 7/2005 | Acher | B23K 26/08 400/621 |
| 2006/0125899 | A1 * | 6/2006 | Cornish et al. | 347/104 |
| 2008/0017617 | A1 | 1/2008 | Watanabe | |
| 2008/0074453 | A1 * | 3/2008 | Furukawa | 347/14 |
| 2014/0335286 | A1 | 11/2014 | Izawa et al. | |

FOREIGN PATENT DOCUMENTS

| | | | | | |
|---|---|---|---|---|---|
| EP | 2801478 | A1 | | 11/2014 | |
| JP | 2001053443 | A | | 2/2001 | |
| JP | 2001097635 | A | * | 4/2001 | B65H 35/06 |
| JP | 2004174927 | A | | 6/2004 | |
| JP | 2004177685 | A | | 6/2004 | |
| JP | 2006123431 | A | | 5/2006 | |
| JP | 2013107712 | A | | 6/2013 | |

OTHER PUBLICATIONS

Japanese Office Action (and English translation thereof) dated Dec. 24, 2015, issued in counterpart Japanese Application No. 2013-190550.

* cited by examiner

LABEL PAPER PROCESSING APPARATUS WITH LASER PROCESSING UNIT AND LOOP FORMING UNITS

BACKGROUND OF THE INVENTION

1. Technical Field

The present invention relates to a label paper processing apparatus for printing a print image on a label sheet of label paper and half-cutting the label paper to form a cutout in the label sheet.

2. Description of the Prior Art

A variety of label paper have so far been proposed in which label (laminated label) paper having a label sheet and a supporting sheet stuck together with a pressure sensitive adhesive is printed on the label sheet with a print image and is then half-cut to form cutouts in the label sheet, the cutout portions of the label sheet that are printed portions being individually peeled off the supporting sheet for use as a label or the like.

A processing apparatus for printing on a label sheet of label paper and half-cutting the label paper in this way is disclosed in JP 2006-123431 A.

To wit, the processing apparatus disclosed is that which includes a printer of intermittent feed type having four printing units serially arranged and a single cutting unit disposed downstream of the printer and that in which the label sheet is printed with a print image by the printer of intermittent feed type and the label paper is half-cut in the cutting unit.

In the label paper processing apparatus disclosed in JP 2006-123431 A, printing plates are exchanged in the printer to print different print images and the cutting unit is provided with a cutting roll having a printed portion cutting edge and a boundary cutting edge and an edge bearing roll such that rotating the cutting and bearing rolls as the label paper is fed to travel forwards and backwards allows the label paper to be half-cut to form cutouts therein.

As a consequence, to meet with a requirement for production of a large variety and small lots of label products which is increasing in recent years, a large number of types of printing plates become necessary together with their respective different cutting edges and so forth, thereby imposing a large burden on a manufacturer in terms of both cost and delivery time.

Also, to prevent the cutting edge from cutting into the supporting sheet of label paper and from cutting the supporting sheet, the depth of cutting to be adjusted is increased and decreased by a small amount of cutting. Such adjustment of a cutting depth requires both time and technique and is troublesome. It is time consuming to adjust and control so when the cutouts are altered in size. In other words, controlling in half-cutting of the label paper is altogether troublesome.

Further, it is likely there to occur for the cutting edge to fail to cut a label sheet and also for a portion of the label sheet cut out to stick to the cutting edge. And, it is time consuming to clean and maintain the cutting edge.

Also, where the label paper is fed to travel intermittently in the printer and continuously in the cutting unit, it is cumbersome to control feeding the label paper to travel.

Made to solve the problems mentioned above, it is an object of the present invention to provide a label paper processing apparatus which can meet with a requirement for production of a large variety and small lots of label products, which can reduce a cost and much shorten a delivery time therefor, thereby not to impose a large burden on manufacture of the products in terms of cost and delivery time, which facilitates controlling in half-cutting of label paper, which does not require time in maintenance thereof and in which it is simplified to control feeding the label paper to travel.

SUMMARY OF THE INVENTION

In accordance with the present invention, there is provided a label paper processing apparatus, characterized in that in a direction in which label paper is fed to travel there are serially arranged a paper supply means for continuously supplying and feeding the label paper, a digital printing means for printing the label paper from the paper supply means with a print image and with a cutting locus along the contour of a shape to be cut out, and a laser processing means for half-cutting the printed label paper along the printed cutting locus with a laser beam irradiated so as to scan and trace the printed cutting locus, thereby forming a half-cutout of the shape in the label paper, the paper supply means, the digital printing means and the laser processing mans each having an independent drive mechanism individually and having no mechanical linkage with each other, the apparatus comprising a pair of loop forming means disposed between the paper supply means and the digital printing means and between the digital printing mans and the laser processing means, respectively, each for forming a loop of the label paper, the paper supply means, the digital printing means and the laser processing means having rates of feed of the label paper therein controllable, respectively, so as to hold a length of the loop in the loop forming mean substantially constant.

The label paper processing apparatus of the present invention may specifically include a loop length detecting sensor for detecting the length of the loop in the loop forming means, the rates of feed of the label paper from the paper supply means and in the laser processing means being controllable, respectively, so as to hold the detected length of the loop at an established set value.

Thus, if the rate of feed of the label paper in the digital printing means is varied, the length of the loop of the label paper between the paper supply means and the digital printing means and the length of the loop of the label paper between the paper supply means and the laser processing means may be held at an established set value, permitting digital printing means varied in type to be interchangeably used.

In the label paper processing apparatus of the present invention, each of the loop forming means may be provided with a tensioning means for applying a tension to the loop.

Applying an appropriate tension to label paper in this way allows the label paper to be fed to travel stably.

In the laser processing means in the label paper processing apparatus of the present invention, the laser beam may have an output and a diameter of its irradiation each fixed constant and a rate of its scanning controlled to set a processing energy thereof so as to be commensurate with a thickness of a label sheet of the label paper.

A half-cutting arrangement to form a cutout is thus provided which is excellent in cut depth precision and which stabilizes the cut depth precision and minimizes variation of the cut depth, permitting a supporting sheet to be made thinner in thickness.

Also, where the output of the laser beam is fixed, its scanning rate can be made faster, permitting the label paper to be half cut while forming a cutout of the label sheet at an increased efficiency, thereby improving the productivity of labels.

In the label paper processing apparatus of the present invention, the digital printing means may be adapted to have the cutting locus printed continuously with a fixed width and in a black color using an ink identical in type to that in which the print image is printed.

This eliminates the need to prepare an ink for exclusive use to print the cutting locus.

Also, printing the cutting locus in a black ink renders its print liable in laser processing to absorb a laser beam processing energy, thereby necessitating a lower amount of processing energy to cut enough and hence reducing the cost of production of labels.

In the label paper processing apparatus of the present invention, the digital printing means may be adapted to print the cutting locus having a width smaller than the diameter of irradiation of the laser beam irradiated thereon.

By irradiating the cutting locus so printed with such a laser beam, the cutting locus is cut (burned out) over its entire widthwise area. Since its print is not left extant and disappears, the label paper cut out or a label is prevented from seeming unsightly due to the locus.

According to the present invention, the use of a digital printing means to print a print image on label paper allows printing different print images thereon readily without expense in time and labor such as of exchanging printing cylinders and thus meeting with a requirement for production of a large variety of and small lots of label products and reducing cost therefor and much shortening delivery time therefor, hence without imposing a large burden on a manufacturer in terms of both cost and delivery time.

Moreover, half-cutting of label paper while it is in continuous travel by irradiating the label paper with the laser beam along the pre-printed cutting locus to form a cutout advantageously reduces operations of control in half-cutting and relieves burdensome adjustments of cut depth as entailed in the prior art. Only a label sheet can be cut out accurately without cutting into a supporting sheet. The apparatus thus facilitates controlling in half-cutting of label paper and, by irradiating with a laser beam, controls without requiring time in maintenance thereof.

Further, each between the paper supply means and the digital printing means and between the digital printing means and the laser processing means, a length of loop of the label paper in a loop forming means is formed which is held substantially constant, allowing the label paper supplied from the paper supply means to be fed to travel serially in the digital printing means and the laser processing means. Feeding the label paper to travel can simply be controlled.

PREFERRED MODES FOR CARRYING OUT THE INVENTION

Figure 1:
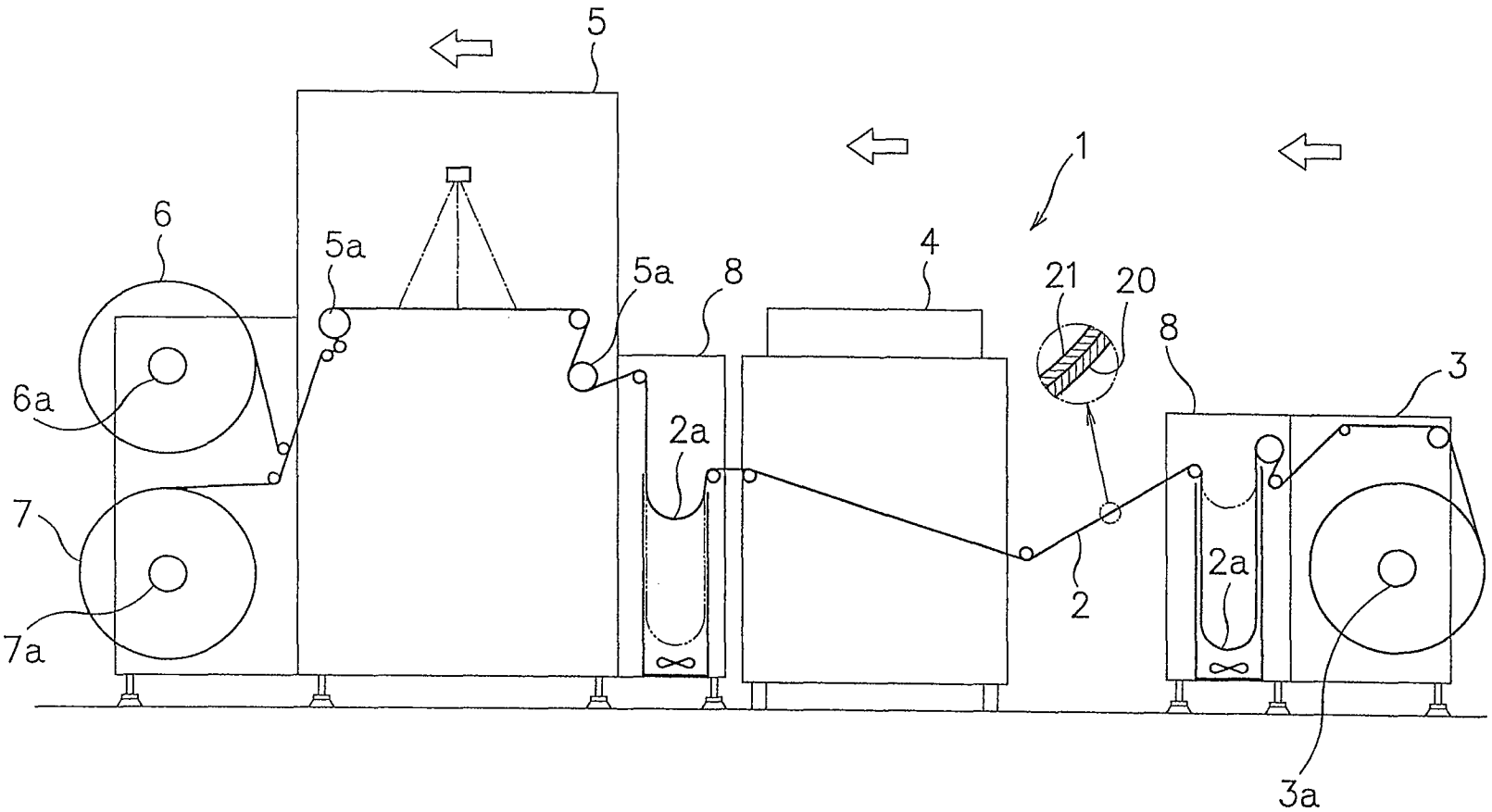
FIG. 1 is a front view that illustrates a label paper processing apparatus as a form of implementation of the present invention.

As shown in FIG. 1, a label paper processing apparatus 1 in accordance with the present invention comprises a paper supply unit 3 that supplies and feeds label sheet 2 continuously, a digital printer 4 disposed downstream of the paper supply unit 3 for printing on the label paper 2, a laser processing unit 5 disposed downstream of the digital printer 4 for half-cutting the label paper 2, a waste removing unit 6 disposed downstream of the laser processing unit 5 and a take-up unit 7 disposed downstream of the waste removing unit 6.

Each between the paper supply unit 3 and the digital printer 4 and between the digital printer 4 and the laser processing unit 5 there is provided a loop forming unit 8 for curving the label paper 2 downwards to form a loop thereof.

The label paper 2 has a supporting sheet 20 and a label sheet 21 stuck together, the label sheet 21 is printed on by the digital printer 4 and the label paper 20 is half-cut to cut out the label sheet 21 by the laser processing unit 5.

The paper supply unit 3 has a rotary member 3*a* rotationally driven by an independent electric motor to cause the label paper 2 rolled up to be unrolled and the label paper 2 with the label sheet facing upwards to be supplied and fed continuously into the digital printer 4.

The paper supply unit 3 has no mechanical linkage with the digital printer 4 or the laser processing unit 5 and has an independent drive mechanism.

The digital printer 4 may be one such as an electrophotographic printer or an ink jet printer using ink jets and not one such as a conventional printer having printing plates exchanged to print different print images. The digital printer 4, having the ability to print different print images with great facility can meet with a requirement for production of a large variety and small lots of label products and can reduce the cost and largely shorten the delivery time therefor, thereby not imposing a large burden on their manufacture in terms of cost and delivery time.

The digital printer 4 has no mechanical linkage with the paper supply unit 3 or the laser processing unit 5 and has an independent drive mechanism.

The laser processing unit 5 comprises a laser oscillator based on $CO_2$ or YAG laser for creating a laser beam, a laser beam amplifying means such as, for example, a beam expander, a means for condensing a laser beam with an optical lens, and one or more reflecting mirrors, wherein controlling the reflecting mirrors allows the focal length and the irradiation position of the laser beam to be varied as desired.

And, the laser processing unit 5 has a pair of feed rolls 5*a* and 5*a* which are each rotationally driven by an independent electric motor. Between the feed rolls 5*a* and 5*a* the label paper 2 is fed to travel linearly and continuously. The label sheet 21 of the label paper 2 fed to travel continuously is irradiated on a surface thereof with a laser beam to half-cut the label paper 2 and to cut out the label sheet 21.

The laser processing unit 5 has no mechanical linkage with the paper supply unit 3 or the digital printer 4 and has an independent drive mechanism as mentioned above.

The waste removing unit 6 has a rotary member 6*a* rotationally driven with an independent electric motor whereby a waste of paper that remains as a part of the label sheet 21 after the label paper 2 is half-cut is peeled off the supporting sheet 20, and is taken up.

The take-up unit 7 has a rotary member 7*a* rotationally driven with an independent electric motor to take up the label paper 2 having that waste of paper peeled off and removed from the supporting sheet 20.

Figure 2:
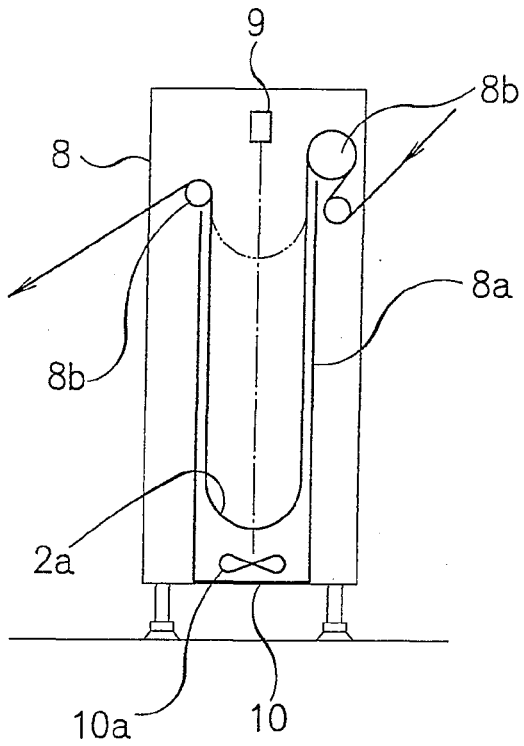
FIG. 2 is an enlarged view of a loop forming unit in the label paper processing apparatus shown in FIG. 1.

The loop forming unit 8 as shown in FIG. 2 includes a wind tunnel 8*a* open upwards and a pair of guide rolls 8*b* and 8*b* disposed upstream and downstream of the opening of the wind tunnel 8*a* in the direction of travel of the label paper 2, respectively, to droop the label paper 2 in the form of a loop, thereby forming the loop 2*a* in the wind tunnel 8*a*.

An amount or length of droop (loop 2*a*) of the label paper 2 in the wind tunnel 8*a* is determined by a difference in feed rate between the label paper in the paper supply unit 3 and the label paper in the digital printer 4 and a difference in feed rate between the label paper in the digital printer 4 and the label paper in the laser processing unit 5.

An amount of droop (length of loop 2*a*) of the label paper 2 in the wind tunnel 8*a* of the loop forming unit 8 is detected by a loop amount or length detecting sensor 9.

And, if the length of loop detected with the loop length detecting sensor is varied from an established set value, the rates of feed of the label paper in the units positioned upstream and downstream of the loop forming unit 8 in the direction of travel of the label paper are varied or controlled to hold the length of loop substantially constant all the time.

This allows the label paper 2 supplied and fed from the paper supply unit 3 to travel continuously or serially in the digital printer 4 and the laser processing unit 5. Feeding the label paper 2 to travel can thus be simply or uncomplicatedly controlled.

For example, when the length of loop in the loop forming unit 8 disposed between the paper supply unit 3 and the digital printer 4 is shorter than an established set value, i.e. when the rate of feed of the label paper in and from the paper supply unit 3 is lower than the rate of feed of the label paper in the digital printer 4, the rate of feed of the label paper in and from the paper supply unit 3 is increased.

When the length of loop is longer than the established set value, i.e. when the rate of feed of the label paper in and from the paper supply unit 3 is higher than the rate of feed of the label paper in the digital printer 4, the rate of feed of the label paper in and from the paper supply unit 3 is decreased.

When the length of loop in the loop forming unit 8 disposed between the digital printer 4 and the laser processing unit 5 is shorter than an established set value, i.e. when the rate of feed of the label paper in the laser processing unit 5 is higher than the rate of feed of the label paper in the digital printer 4, the rate of feed of the label paper in the laser processing unit 5 is decreased.

When the length of loop is longer than the established set value, i.e. when the rate of feed of the label paper in the laser processing unit 5 is lower than the rate of feed of the label paper in the digital printer 4, the rate of feed of the label paper in the laser processing unit 5 is increased.

The loop forming unit 8 is provided with a tensioning means 10 that applies a tension substantially constant to the loop 2*a*.

The tensioning means 10 includes a suction fan 10*a* disposed at a lower part of the wind tunnel 8*a*. The suction fan 10*a* is rotationally driven to draw air in the wind tunnel 8*a* out, reducing pressure in the wind tunnel 8*a*, to pull the loop 2*a* of label paper 2 downwards and thereby to provide a tension to the loop 2*a* of label paper 2.

A tension can thus be applied, in a contactless state, to the label sheet 2.

Varying the speed of rotation of the suction fan 10*a* to adjust the suction pressure by which the pressure in the wind tunnel 8*a* is reduced allows the tension applied to the loop 21 of label paper 2 to be adjusted.

For example, the higher the rotational speed of the suction fan 10*a*, the higher the suction pressure by which the pressure in the wind tunnel 8*a* is reduced, and the stronger becomes the tension.

The lower the rotational speed of the suction fan 10*a*, the lower the suction pressure to which the pressure in the wind tunnel 8*a* is reduced, and the weaker becomes the tension.

The tensioning means 10 is not limited to what is mentioned above.

For example, the loop 2*a* of label paper 2 may have a tension roll held or embraced thereby whose downward force applied by such as a cylinder is made variable.

The paper supply unit 3, the digital printer 4 and the laser processing unit 5 for serial arrangement in the direction of travel of the label paper 2 are thus used each having an independent drive mechanism individually and having no mechanical linkage with each other, allowing any combination as desired to be made of various forms of the paper supply unit 3, the digital printer 4 and the laser processing unit 5 to constitute a label paper processing apparatus of the present invention.

Moreover, the length of loop each in the loop forming unit 8 provided between the paper supply unit 3 and the digital printer 4 and in the loop forming unit 8 provided between the digital printer 4 and the laser processing unit 5 is held substantially constant all the time by controlling the rate of feed of the label paper in and from the paper supply unit 3 and the rate of feed of the label paper in the laser processing unit 5.

To wit, a loop forming unit 8 is provided at each of the label paper inlet (upstream) side to and the label paper outlet (downstream) side from the digital printer 4 so that the label paper 2 is fed out into and collected from the digital printer 4 at a rate of feed as equal to a rate of transport of the label paper 2 in the digital printer 4.

This allows using a plurality of digital printers 4 interchangeably of different types having different rates of transport of the label paper therein to print on the label sheet 21 of label paper 2 to be then cut out.

Further, the tensioning means 10 provided each between the paper supply unit 3 and the digital printer 4 and between the digital printer 4 and the laser processing unit 5 for applying an appropriate tension to the label paper 2 to stabilize traveling of the label paper 2 allows the label paper 2 supplied from the paper supply unit 3 to be fed to travel stably, ensuring an operation of printing by the digital printer 4 on the label sheet 21 of label paper 2 and an operation of cutting out the label sheet 21 (or half-cutting the label paper 2) by the laser processing unit 5.

An explanation is next given of an embodiment of the method of processing the label paper 2.

The label paper 2 having the label sheet 21 facing upwards and the supporting sheet 20 lying down is supplied continuously from the paper supply unit 3 towards the digital printer 4.

In the digital printer 4, there are printed a print image and a cutting locus on a surface of the label sheet 21.

Mention is next made of a specific example of printing a cutting locus.

Figure 3:
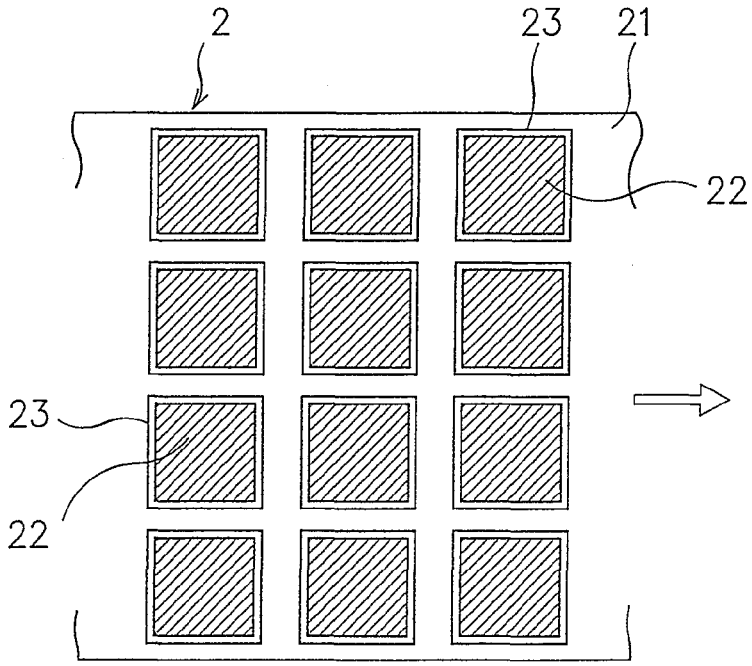
FIG. 3 is a top plan view that illustrates label paper printed with a print image and a cutting locus.

As shown in FIG. 3, a surface of the label sheet 21 is printed with a print image 22, and a surface area of the surface in which there is no print image 22 (i.e. a blank or marginal area around the print image 22) is printed with a cutting locus 23 in a simple black color using an ink identical in type to that which is used to have the print image 22 printed.

The cutting locus 23 is a locus along the contour of a shape to be cut out.

While the label paper 2 having the print image 22 and the cutting locus 23 printed is being continuously fed to travel forwards in the laser processing unit 5, only the label sheet 21 is cut thereby and cut along the printed cutting locus 23 with the laser beam irradiated so as to scan and trace the cutting locus 23.

To wit, the label paper 2 is half-cut with the laser beam irradiated so as to scan and trace the printed cutting locus 23, thereby forming a cutout exclusively in the label sheet 21.

Half-cutting of the label paper 2 while it is in continuous travel with the laser beam irradiated along the pre-printed cutting locus 23 to form cutouts in accordance with the present invention advantageously reduces operations of control in half-cutting and relieves burdensome adjustments of cut depth as entailed in the prior art, sharply shortening the preparatory period of a half-cutting operation, and thereby improving the efficiency of production of labels.

Further, irradiation with a laser beam to cut yields a cut depth in precision, giving rise to precise cutting of a label sheet 21 without cutting into a supporting sheet 20.

Permitting the supporting sheet 20 thus to be made thinner allows reducing the amount of a waste (the supporting sheet 20 from which the label sheet 21 including labels is peeled off), costing down the label paper 2.

To wit, the possibility of the conventional apparatus that a supporting sheet 20 may be cut through the label paper 2 has so far required so thickening the supporting sheet 20 that it can no longer be cut through, this increasing the amount of the waste and costing up the label paper 2.

Further, cutting by irradiation with a laser beam as a tool renders it possible to ensure that the tool if used over an extended period of time may be held there-over to precisely cut a label sheet 21, and makes its maintenance the least time-consuming.

Mention is next made more specifically of cutting a label sheet 21 with a laser beam.

A depth of cutting effected by irradiating a surface of the label sheet 21 with the laser beam is determined by a processing energy of the laser beam and a color of the surface of the label sheet 21.

To wit, the larger or smaller the processing energy of a laser beam, the deeper or shallower the cut depth. And, the darker or brighter the color of the surface of the label sheet 21, that is, the higher or lower the efficiency of absorption by the surface of the laser beam, the deeper or shallower the cut depth.

The laser beam has a processing energy determined by an output, a time period of irradiation and a density of irradiation of the laser beam. Thus, a processing energy of the laser beam can be adjusted by varying an output, a time period of irradiation and/or a density of irradiation of the laser beam.

The time period of irradiation is controlled by varying a scanning rate or speed of the laser beam, and the density of irradiation of the laser beam is varied by varying an irradiation diameter, i.e. the diameter of a spot upon which the laser beam impinges on the surface being processed.

In accordance with the present invention, a processing energy of the laser beam in half-cutting the label paper 2 to form a cutout in the label sheet 21 is set so that cutting with the laser beam results in a depth of cut that becomes equal to a thickness of the label sheet 21. The label sheet 21 alone can thus be precisely cut without cutting into the supporting sheet 20.

For example, with an output and a spot diameter each fixed of the laser beam, its scanning rate is varied so as to set a processing energy of the laser beam such that the depth of cutting is equal to the thickness of the label sheet 21.

A half-cutting and cutout forming arrangement is thus provided which is excellent in cut depth precision and which stabilizes the cut depth precision and minimizes variation of the cut depth, permitting the supporting sheet 20 to be made thinner in thickness.

Also, where the output of a laser beam is fixed, its scanning rate can be made faster, permitting the label paper 2 to be half cut while forming cutouts in the label sheet 21 at an increased efficiency, thereby improving the productivity of labels.

The cutting locus 23 is continuously printed having its width unvaried.

The cutting locus 23 is printed having a width made smaller than a spot diameter of the laser beam. Note here that the spot diameter Φ is preferably from 0.2 mm to 0.3 mm.

By irradiating the cutting locus 23 so printed with such a laser beam, the cutting locus 23 is cut (burned out) over its entire widthwise area. Since its print is not left extant but disappears, the label paper 2 half-cut and cut out, i.e. a label, is prevented from seeming unsightly due to the locus.

Printing the cutting locus 23 in a black ink renders its print liable in laser processing to absorb a laser beam processing energy, getting off with a less amount of processing energy to cut enough and hence reducing the cost of production of labels.

Figure 4:
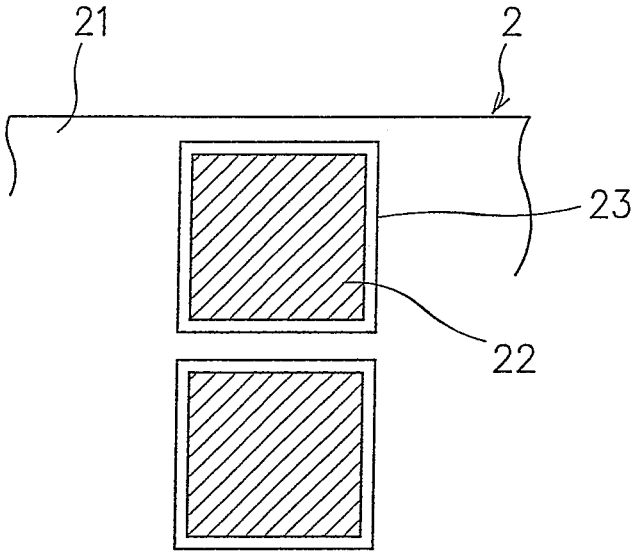
FIG. 4 is an explanatory view that illustrates a print image and a cutting locus.
Figure 5:
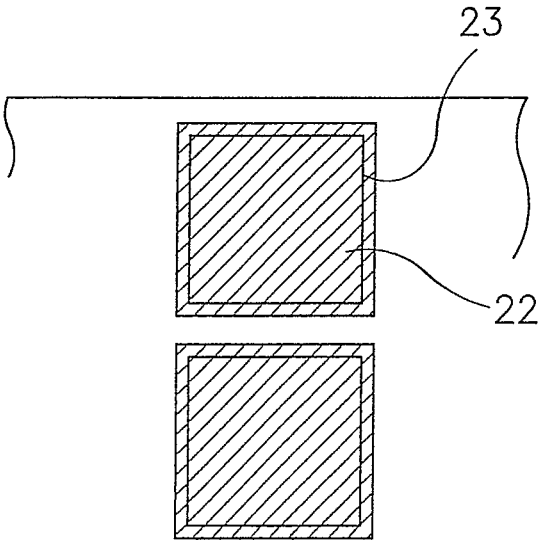
FIG. 5 is an explanatory view that illustrates a print image and a cutting locus which is printed in a region of the print image.

Moreover, whichever of the cutting locus 23 printed in an area in which there is no print image 22 as shown in FIG. 4 and the cutting locus 23 printed in an area in which there is a print image 22 as shown in FIG. 5 can likewise be cut with a laser beam regardless of a background of the cutting locus.

The ink that can be used to print the cutting locus may be an ink which is identical in type to that for use to print a print image 22.

This eliminates the need to prepare an ink for exclusive use to print the cutting locus.

The laser processing unit 5 includes control units for controlling the output of the laser oscillator and the scanning rate of the laser beam, respectively.

And, in cutting along a straight or curved line of the cutting locus, the output of the laser oscillator and the scanning rate of the laser beam are controlled so that the scanning rate is varied so as to be first accelerated, next to be uniform and then to be decelerated while cutting from a starting point to an end point.

Also, a joint portion (such as a corner portion) of the cutting locus is cut while controlling the output of the laser oscillator and the scanning rate of the laser beam so that a cutout shape of the cutting locus may remain having a given width and may not deteriorate in its quality.

What is claimed is:

1. A label paper processing apparatus comprising:

a paper supply unit which continuously supplies and feeds a label paper, a digital printing unit which prints on the label paper from the paper supply unit, a print image and a cutting locus along a contour of a shape to be cut out, and a laser processing unit which half-cuts the printed label paper along the printed cutting locus with a laser beam irradiated so as to scan and trace the printed cutting locus, thereby forming a half-cutout of said shape in the label paper, wherein:

said paper supply unit, said digital printing unit and said laser processing unit are serially arranged in a label paper feeding direction, said paper supply unit, said digital printing unit and said laser processing unit, each has an independent drive mechanism individually, and have no mechanical linkage with each other, the label paper processing apparatus further comprises a pair of loop forming units disposed between said paper supply unit and said digital printing unit, and between said digital printing unit and said laser processing unit, respectively, wherein each of said pair of loop forming units forms a loop of the label paper, said paper supply unit, said digital printing unit and said laser processing unit each has a controllable rate of feed of the label paper so as to hold lengths of the loops in said pair of loop forming units substantially constant, in said laser processing unit, said laser beam has an output and a beam spot diameter of irradiation each of which is fixed so as to be constant and wherein a rate of scanning of the laser beam is controlled to set a processing energy of the laser beam to be commensurate with a thickness of a label sheet of the label paper, said digital printing unit prints said cutting locus continuously with a fixed width and in a black color using an ink that is identical in type to an ink with which the print image is printed, and the printed fixed width of said cutting locus is smaller than the beam spot diameter of irradiation of the laser beam irradiated on the cutting locus.

2. The label paper processing apparatus as set forth in claim 1, further comprising a loop length detecting sensor which is disposed in each of the pair of loop forming units and which detects the length of a corresponding loop in a corresponding loop forming unit, and wherein the rates of feed of the label paper in said paper supply unit and said laser processing unit are controlled, so as to hold said detected length of the loop in each loop forming unit at an established set value.

3. The label paper processing apparatus as set forth in claim 2, wherein each of said pair of loop forming units includes a tensioning unit which applies a tension to said loop.

* * * * *